US008096733B2

(12) United States Patent
Jinnings et al.

(10) Patent No.: US 8,096,733 B2
(45) Date of Patent: Jan. 17, 2012

(54) APPARATUS FOR INSERTING SHEET PILE HAVING AN INDEPENDENTLY ADJUSTABLE INSERTION AXIS AND METHOD FOR USING THE SAME

(75) Inventors: John W. Jinnings, Leo, IN (US); Mark Gustin, Harlan, IN (US)

(73) Assignee: Hercules Machinery Corporation, Fort Wayne, IN (US)

( * ) Notice: Subject to any disclaimer, the term of this patent is extended or adjusted under 35 U.S.C. 154(b) by 348 days.

(21) Appl. No.: 12/500,906

(22) Filed: Jul. 10, 2009

(65) Prior Publication Data

US 2011/0008111 A1 Jan. 13, 2011

(51) Int. Cl.
*E02D 17/18* (2006.01)

(52) U.S. Cl. ..... 405/232; 405/274; 405/276; 173/49; 173/184

(58) Field of Classification Search ..... 405/232, 405/274, 276; 173/49, 184, 185
See application file for complete search history.

(56) References Cited

U.S. PATENT DOCUMENTS

| | | | | |
|---|---|---|---|---|
| 1,637,586 | A | 8/1927 | Pates | |
| 1,689,378 | A | 10/1928 | Mauterer | |
| 2,121,291 | A | 6/1938 | Habe | |
| 2,210,788 | A | 8/1940 | Anderson | |
| 2,908,140 | A | 10/1959 | Everson, Jr. | |
| 3,008,528 | A * | 11/1961 | Berthet et al. | 173/49 |
| 4,436,452 | A * | 3/1984 | Bodine | 405/232 |
| 4,730,427 | A | 3/1988 | Tomsin | |
| 4,917,543 | A | 4/1990 | Cole et al. | |
| 5,085,539 | A | 2/1992 | Massarsch | |
| 5,154,539 | A | 10/1992 | McCown, Sr. et al. | |
| 5,568,997 | A * | 10/1996 | Raunisto | 405/232 |
| 5,659,985 | A | 8/1997 | Stump | |
| 5,823,272 | A * | 10/1998 | van Halteren | 173/49 |
| 6,073,704 | A * | 6/2000 | Yasuoka et al. | 173/49 |
| 6,140,819 | A | 10/2000 | Peterman et al. | |
| 6,234,719 | B1 * | 5/2001 | Roynestad | 405/232 |
| 6,273,641 | B1 | 8/2001 | Bull | |
| RE37,661 | E | 4/2002 | Raunisto | |
| 6,386,295 | B1 * | 5/2002 | Suver | 405/232 |

(Continued)

FOREIGN PATENT DOCUMENTS

FR 2 789 096 8/2000

(Continued)

OTHER PUBLICATIONS

EP Search Report dated Dec. 9, 2009 in corresponding EP Application No. 09011981.8.

(Continued)

*Primary Examiner* — Frederic L Lagman
(74) *Attorney, Agent, or Firm* — Baker & Daniels LLP

(57) ABSTRACT

An apparatus and method for the subterranean support of underground conduits is disclosed, including a pile driver that is configured to connect to an articulated boom of an excavator or another unit of positioning machinery to insert a section of curved sheet pile beneath a conduit. In one exemplary embodiment, the pile driver has a head portion and a body portion. The head portion of the pile driver is connected to the excavator and the body portion of the pile driver is moveable relative to both the head portion of the pile driver and the excavator to allow the pile driver to properly orient a section of curved sheet pile for insertion into subterranean material beneath an underground conduit.

12 Claims, 11 Drawing Sheets

U.S. PATENT DOCUMENTS

| | | | | |
|---|---|---|---|---|
| 6,437,726 | B1 | 8/2002 | Price | |
| 6,575,663 | B2 | 6/2003 | Kostelnik et al. | |
| 6,710,741 | B2 | 3/2004 | Tucker | |
| 6,715,964 | B2 | 4/2004 | Nottingham | |
| 6,735,888 | B2 | 5/2004 | Green et al. | |
| 6,751,553 | B2 | 6/2004 | Young et al. | |
| 6,758,634 | B2 | 7/2004 | Nickelson et al. | |
| 6,851,890 | B2 | 2/2005 | Kostelnik et al. | |
| 6,975,942 | B2 | 12/2005 | Young et al. | |
| 7,062,414 | B2 | 6/2006 | Waite et al. | |
| 7,113,124 | B2 | 9/2006 | Waite | |
| 7,175,369 | B2 | 2/2007 | Fomenkov et al. | |
| 7,400,976 | B2 | 7/2008 | Young et al. | |
| 7,407,343 | B2 * | 8/2008 | van Halteren et al. | 405/232 |
| 2004/0208708 | A1 | 10/2004 | Nottingham | |
| 2004/0208710 | A1 | 10/2004 | Shreider et al. | |
| 2004/0265068 | A1 | 12/2004 | Guedes De Melo et al. | |
| 2006/0042811 | A1 * | 3/2006 | Hagemeyer | 173/184 |
| 2006/0140727 | A1 * | 6/2006 | Halteren et al. | 405/274 |
| 2006/0193701 | A1 | 8/2006 | Nottingham | |
| 2008/0110657 | A1 * | 5/2008 | Gunnarson | 173/184 |
| 2008/0304917 | A1 * | 12/2008 | van Halteren et al. | 405/232 |
| 2008/0310923 | A1 * | 12/2008 | Jinnings et al. | 405/232 |
| 2009/0057521 | A1 | 3/2009 | Bootsman | |

FOREIGN PATENT DOCUMENTS

| | | |
|---|---|---|
| JP | 3-279516 | 12/1991 |
| NL | 8501196 | 11/1986 |
| NL | 9402133 | 7/1996 |

OTHER PUBLICATIONS

EP Search Report dated Nov. 26, 2009 in corresponding EP Application No. 09011983.5.

EP Search Report dated Nov. 5, 2009 in corresponding EP Application No. 09011982.7.

* cited by examiner

APPARATUS FOR INSERTING SHEET PILE HAVING AN INDEPENDENTLY ADJUSTABLE INSERTION AXIS AND METHOD FOR USING THE SAME

BACKGROUND

1. Field of the Invention

The present invention relates to an apparatus and method for the subterranean support of underground conduits.

2. Description of the Related Art

Particularly in urban environments, when it is necessary to lay water or sewer pipe, construction crews will often encounter buried electrical, telephone, and/or fiber optic cables. These cables are typically encased in a conduit structure, such as a clay tile or raceway that has a plurality of longitudinal holes through which the cables are pulled. In order to create a unitary subterranean support structure for the cables, individual raceway sections are placed end-to-end and mortared together. In order to lay another conduit, such as water or sewer pipes that must be buried below the freeze line, it is necessary to excavate beneath the raceway and the cables contained therein. When excavation occurs beneath the raceway, the raceway must be supported to prevent the raceway from collapsing into the excavated hole.

Currently, in order to support the raceway during and after excavation, the individual raceway tiles are jack hammered, causing the raceway tiles to break apart and expose the cables positioned therein. The exposed cables are then supported by one or more beams extending above the excavated hole. Once the water or sewer pipe is laid, the hole is backfilled and a concrete form is built around the cables. The form is filled with concrete and the concrete is allowed to harden. As a result, the cables are encased within the concrete and are protected from future damage. While this process is effective, it is also time consuming and expensive. Additionally, once the cables are encased in concrete, it is no longer possible to pull new cables through the raceway or to easily extract existing cables from the raceway.

SUMMARY

The present invention relates to an apparatus and method for the subterranean support of underground conduits. For purposes of the present invention, the term "conduit" includes elongate structures, such as raceways or conduits for wires, cables and optical fibers, pipes, cables, and the like. The present invention includes a pile driver that is configured to connect to an articulated boom of an excavator or another unit of positioning machinery to insert a section of curved sheet pile beneath a conduit. For purposes of the present invention, the phrase "pile driver" includes vibratory pile drivers, impact pile drivers, hydraulic pile drivers, and hydrostatic jacking mechanisms. In one exemplary embodiment, the pile driver has a head portion and a body portion. The head portion of the pile driver is connected to the excavator and the body portion of the pile driver is moveable relative to both the head portion of the pile driver and the excavator to allow the pile driver to properly orient a section of curved sheet pile for insertion into subterranean material beneath an underground conduit.

Additionally, the body portion of the pile driver includes an upper support head and a lower drive head, with the lower drive head being rotatable relative to the upper support head about a fixed pivot element. In one exemplary embodiment, the pile driver includes a connection mechanism for connecting a section of curved sheet pile to the pile driver. With a section of curved sheet pile connected to the pile driver by the connection mechanism, the section of curved sheet pile may be advanced into subterranean material beneath an underground conduit by rotating the lower drive head of the body of the pile driver relative to the upper support head of the body of the pile driver about the fixed pivot element.

In one exemplary embodiment, the fixed pivot element about which the lower drive head is rotatable relative to the upper support head defines an insertion axis. The insertion axis is separated from the connection mechanism of the pile driver by an insertion distance. In one exemplary embodiment, the insertion distance is substantially equal to the radius of curvature of the curved sheet pile. As a result, when the section of curved sheet pile is connected to the pile driver by the connection mechanism, the center of the radius of curvature of the section of curved sheet pile lies substantially on the insertion axis, i.e., the rotational axis defined by the fixed pivot element between the upper support head and the lower drive head. This allows the curved sheet pile to be advanced beneath the conduit without the need to move or further adjust the position of either an articulated boom of the excavator or the vibratory pile driver during the advancement of the curved sheet pile beneath the conduit.

Additionally, since the head portion of the pile driver is connected to the excavator and the fixed pivot element of the pile driver that defines the insertion axis is contained within the body portion of the pile driver, the insertion axis is not defined by the connection between the head portion of the pile and the articulated boom of the excavator. This allows for the insertion axis of the pile driver to be moveable relative to the articulated boom of the excavator. Advantageously, because the insertion axis is not defined by the connection between the articulated boom of the excavator and the head portion of the pile driver, the excavator may be positioned in substantially any desired location and orientation relative to the conduit beneath which curved sheet pile is to be placed, while still allowing the curved sheet pile to be properly positioned for insertion into subterranean material. Stated another way, the arcuate path along which the curved sheet pile is inserted may be altered without the need to alter the position of the articulated boom of the excavator. This is beneficial, particularly in urban environments, where limited access to the conduit may be available and/or where buildings or other structures may limit the ability to position the excavator relative to the conduit. Specifically, once the excavator has positioned the pile driver adjacent to the conduit, the pile driver and the section of curved sheet pile connected to the pile driver are manipulated independently of the excavator to align the section of curved sheet pile with the conduit and to advance the section of curved sheet pile along an arcuate path into the subterranean material and beneath the conduit.

In one form thereof, the present invention provides a system for the insertion of curved sheet pile, the system including a pile driver. The pile driver includes a head portion configured to connect to a unit of positioning machinery. The head portion defines a first fixed pivot element and the first fixed pivot element defines a pile driver axis of rotation about which the pile driver is rotatable. The pile driver further includes a body portion having an upper support head and a lower drive head. The upper support head is connected to the head portion of the body. The lower drive head is connected to the upper support head to define a second fixed pivot element. The second fixed pivot element defines an insertion axis. The lower drive head includes a connection mechanism and the insertion axis is spaced from the connection mechanism by an insertion distance. The system also includes a section of curved sheet pile having a pile radius of curvature, with the pile radius of curvature being substantially equal to the insertion distance, wherein, with the section of curved sheet pile secured between the opposing clamp surfaces of the clamp, a point defining a center of the pile radius of curvature lies substantially on the insertion axis.

In another form thereof, the present invention provides a system for the insertion of curved sheet pile, the system including a pile driver. The pile driver includes a head portion configured to connect to an arm of a unit of positioning machinery, wherein the arm has a longitudinal axis. The pile driver also includes a body portion having an upper support head and a lower drive head. The upper support head of the body is connected to the head portion of the pile driver. The lower drive head is connected to the upper support head. The lower drive head has a fixed pivot element defining an insertion axis. The fixed pivot element is rotatable relative to the longitudinal axis of the arm of the unit of positioning machinery to alter the position of the insertion axis. The lower drive head has a connection mechanism and the connection mechanism is spaced from the insertion axis by an insertion distance. The system also includes a section of curved sheet pile having a pile radius of curvature. The pile radius of curvature is substantially equal to the insertion distance, wherein, with the section of curved sheet pile connected to the lower drive head by the connection mechanism, a point defining a center of the pile radius of curvature lies substantially on said insertion axis and the lower drive head is rotatable about the insertion axis to insert the section of curved sheet pile into subterranean material.

In yet another form thereof, the present invention provides a system for the insertion of curved sheet pile. The system includes a pile driver having a head portion configured to connect to an arm of a unit of positioning machinery, wherein the arm has a longitudinal axis, and a body portion connected to the head portion of the pile driver. The body portion has a rotation mechanism operable to drive rotation of at least a portion of the body portion relative to the head portion about a body axis of rotation. The body also has a fixed pivot element defining an insertion axis. The fixed pivot element is rotatable about the body axis of rotation and relative to the longitudinal axis of the arm of the unit of positioning machinery to alter the position of the insertion axis. The body has a connection mechanism. The connection mechanism is spaced from the insertion axis by an insertion distance. The insertion axis is positioned between the rotation mechanism and the connection mechanism when the connection mechanism is rotated about the insertion axis. The system also includes a section of curved sheet pile having a pile radius of curvature. The pile radius of curvature is substantially equal to the insertion distance, wherein, with the section of curved sheet pile connected to the body portion by the connection mechanism, a point defining a center of the pile radius of curvature lies substantially on the insertion axis and the connection mechanism is rotatable about the insertion axis to insert the section of curved sheet pile into subterranean material.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION

Figure 1:
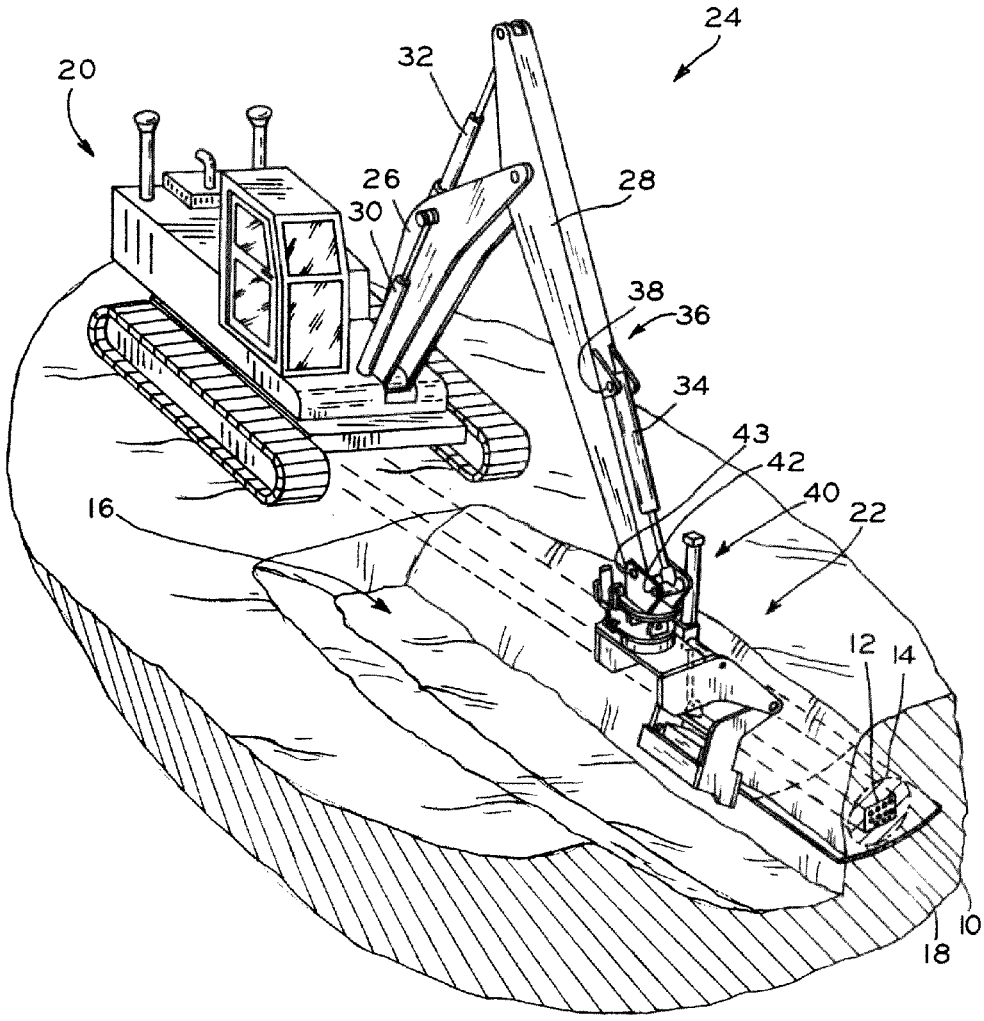
FIG. 1 is perspective view of an excavator and a vibratory pile driver according to an exemplary embodiment of the present invention inserting a section curved sheet pile beneath a conduit.

Referring to FIG. 1, the installation of a plurality of sections of curved sheet pile 10 beneath conduit 12 is shown. As depicted herein, conduit 12 is a raceway, which has a plurality of openings extending along its longitudinal axis for the receipt of wires, cables, or other types of conduit therethrough. However, while depicted herein as a raceway, conduit 12 may be any type of conduit, such as a gas line, an oil line, an individual wire or bundle of wires, a fiber optic line or bundle of fiber optic lines, a sewer line, a gas line, a fuel line, an electric line, an aqueduct, a phone line, and/or any other type of known conduit or a combination thereof Exclusion zone 14 defines an area that extends around conduit 12 by a predetermined distance. Exclusion zone 14 may be entered into an electronic control system or may be set by an electronic control system, which will prevent curved sheet pile 10 from entering exclusion zone 14 during the insertion of curved sheet pile 10. Specifically, the electronic control system may be used to control the insertion of curved sheet pile 10 and may be programmed to stop the insertion of curved sheet pile 10 if the control system determines that continued movement of curved sheet pile 10 may result in curved sheet pile 10 entering exclusion zone 14.

As shown in FIG. 1, trench 16 is dug adjacent to conduit 12 to provide access to the soil adjacent to conduit 12. Curved sheet pile 10 is inserted into soil or other subterranean material 18 using positioning machinery such as excavator 20 and vibratory pile driver 22. Excavator 20 includes articulated boom 24 having arms 26, 28 that are actuated by cylinders 30, 32, respectively. Articulated boom 24 also includes hydraulic cylinder 34 connected to arm 28 at first end 36 by pin 38 and connected to pile driver 22 at second end 40 by pin 42. Pile driver 22 is also connected to arm 28 of articulated boom 24 by pin 43, which defines a fixed pile driver pivot element about which pile driver 22 may be rotated relative to articulated boom 24 and arm 28.

As described and depicted herein, pile driver 22 is a vibratory pile driver. However, pile driver 22 may be a non-vibratory pile driver that relies substantially entirely on hydraulic force to advance curved sheet pile 10 into subterranean material 18. In one exemplary embodiment, pile driver 22 relies on the hydraulic fluid pumped by excavator 20 to drive curved sheet pile 10 into subterranean material 18. Further, while described and depicted herein as being used in conjunction with excavator 20, pile driver 22, may be used in conjunction with any unit of positioning machinery capable of lifting pile driver 22 and providing hydraulic fluid thereto. In other embodiments, pile driver 22 may be used with a unit of positioning machinery that does not supply hydraulic fluid to the pile drivers, but, instead, relies on a separate pump system to provide hydraulic fluid to the pile drivers.

Figure 2:
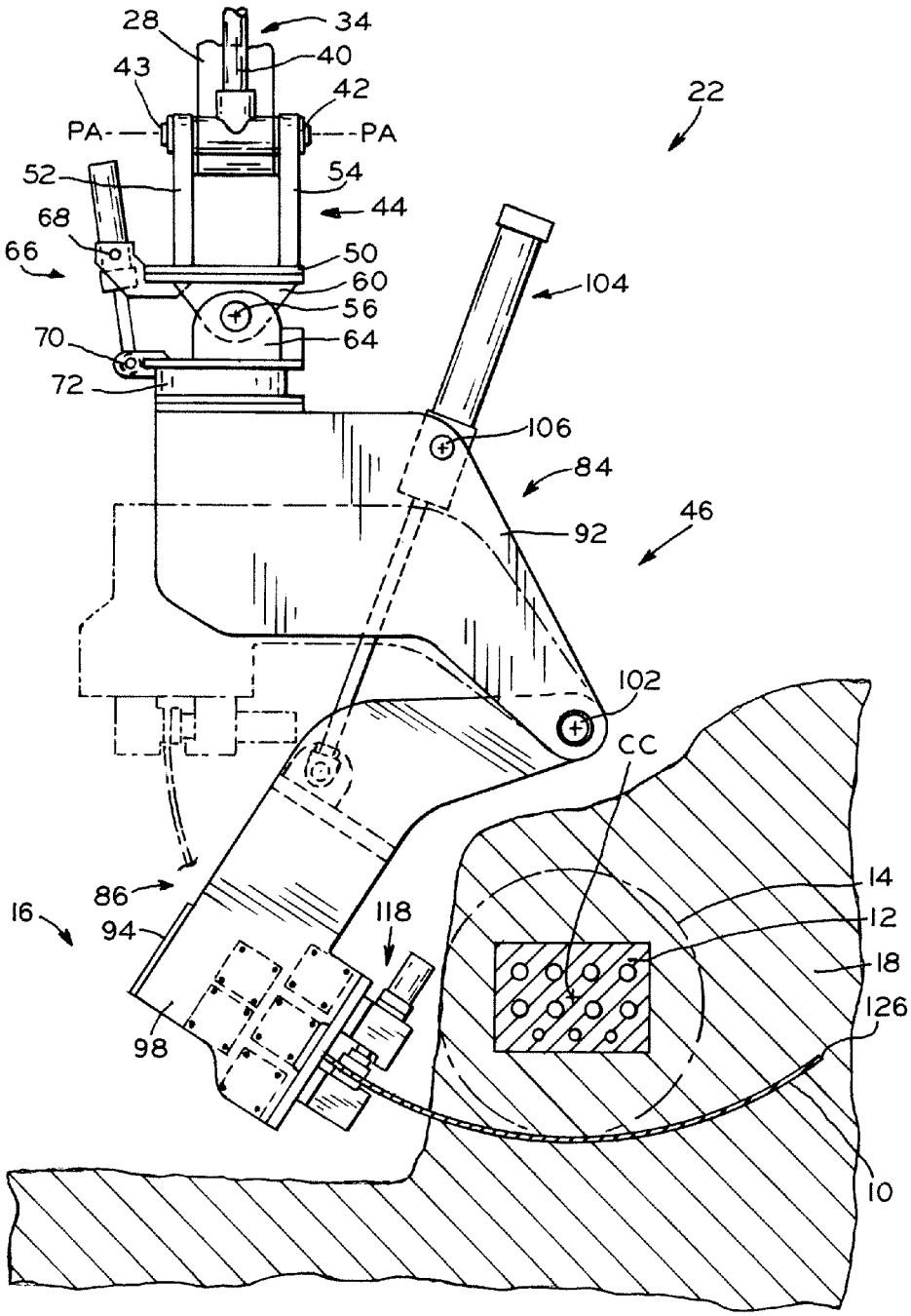
FIG. 2 is a fragmentary, partial cross-sectional view of the pile driver, excavator, curved sheet pile, and conduit of FIG. 1.
Figure 3:
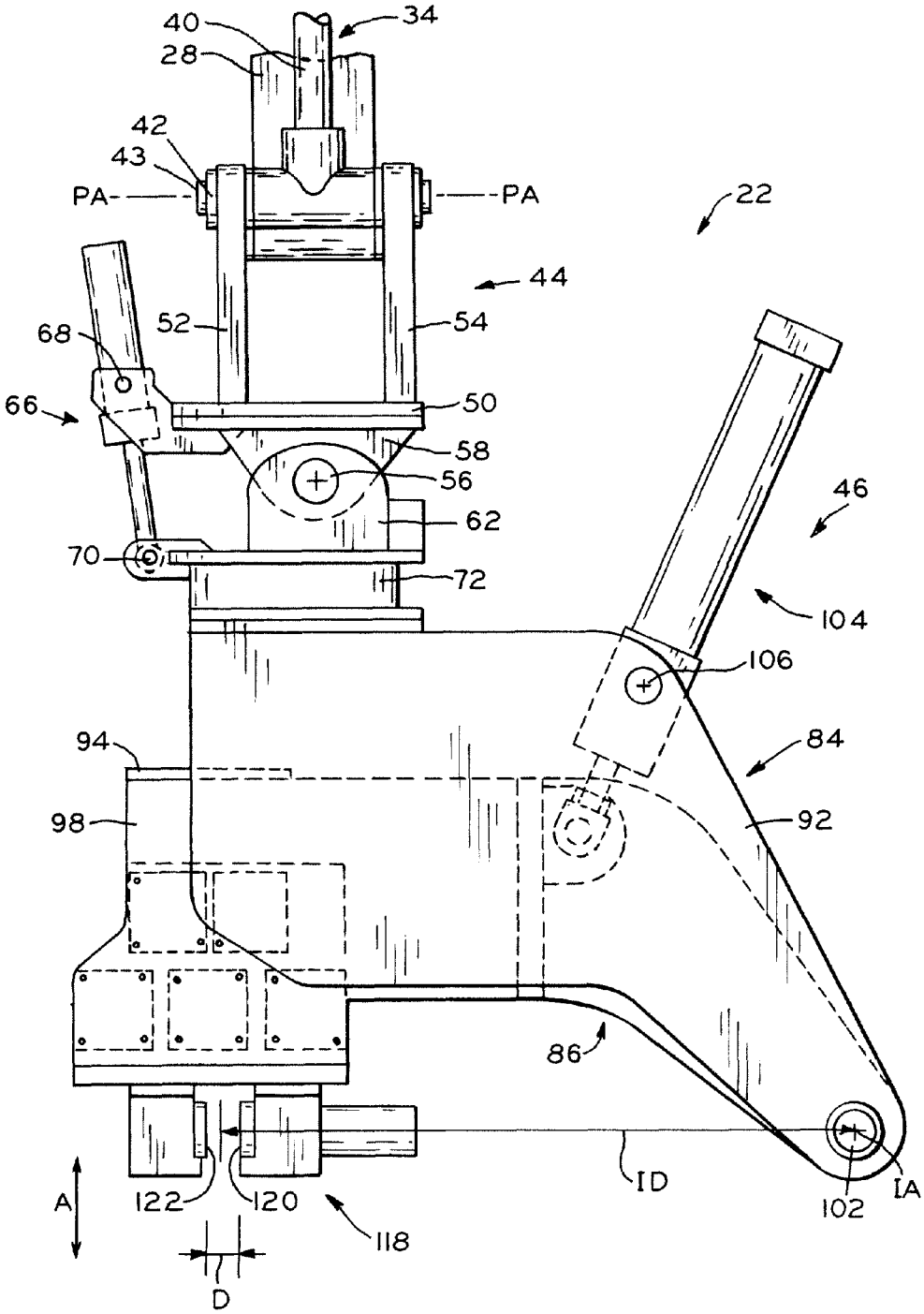
FIG. 3 is a side, elevational view of the vibratory pile driver and articulated boom of the excavator of FIG. 1.
Figure 4:
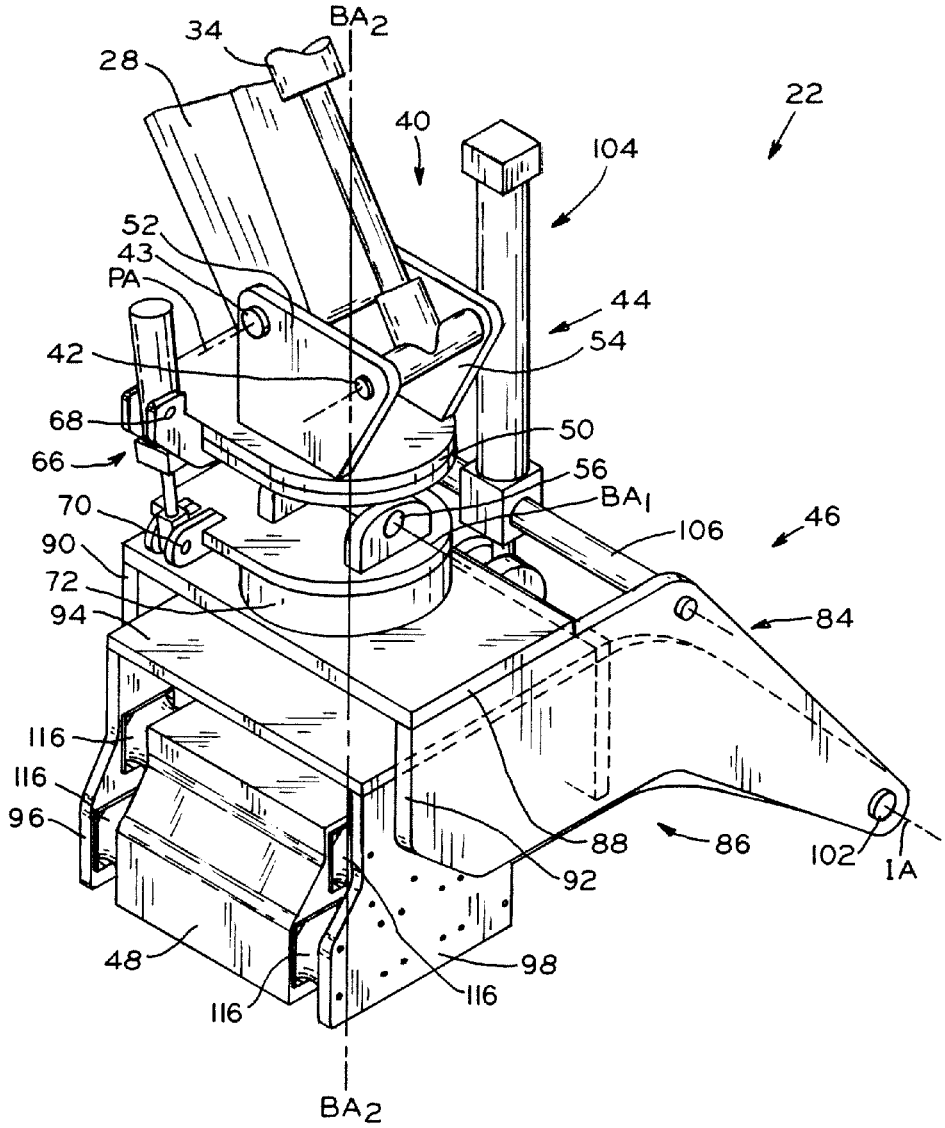
FIG. 4 is a fragmentary, perspective view of the vibratory pile driver and an articulated boom of the excavator of FIG. 1.

In one exemplary embodiment, shown in FIGS. 2-7, pile driver 22 includes head portion 44, body portion 46, and vibration generator 48. Head portion 44 of pile driver 22 includes support plate 50 having opposing side plates 52, 54 that extend upwardly from support plate 50 at a distance spaced apart from one another. Referring to FIGS. 3 and 4, side plates 52, 54 include two pairs of opposing openings that extend through side plates 52, 54 and that are configured to receive and support pins 42, 43. As indicated above, pin 42 secures hydraulic cylinder 34 to pile driver 22. Specifically, pin 42 extends through a first opening in plate 52, through an opening formed in second end 40 of cylinder 34, and through an opposing opening in plate 54 to secure cylinder 34 to pile driver 22. A pin or other known fastener may be used to secure pin 42 in position and prevent translation of pin 42 relative to plates 52, 54.

Similarly, pin 43 is received through a first opening in plate 52, an opening formed in arm 28 of articulated boom 24, and through an opening in plate 54 to secure arm 28 of articulated boom 24 to pile driver 22. A pin or any other known fastener may also be used to secure pin 43 in position and prevent translation of pin 43 relative to plates 52, 54. With pin 43 secured in this position, pin 43 defines pile driver rotational axis PA (FIG. 2), about which pile driver 22 is rotatable relative to articulated boom 24. Specifically, pin 43 defines a fixed pile driver pivot element about which pile driver 22 may be rotated. By actuating hydraulic cylinder 34, a force is applied to pile driver 22 by cylinder 34 via pin 43, which causes pile driver 22 to rotate about pile driver rotational axis PA defined by pin 43. While pin 43 is described and depicted herein as forming a fixed pile driver pivot element about which pile driver 22 is rotatable, any known mechanism for creating an axis of rotation, such as a worm gear mechanism, may be used to form the fixed pile driver pivot element.

Figure 5:
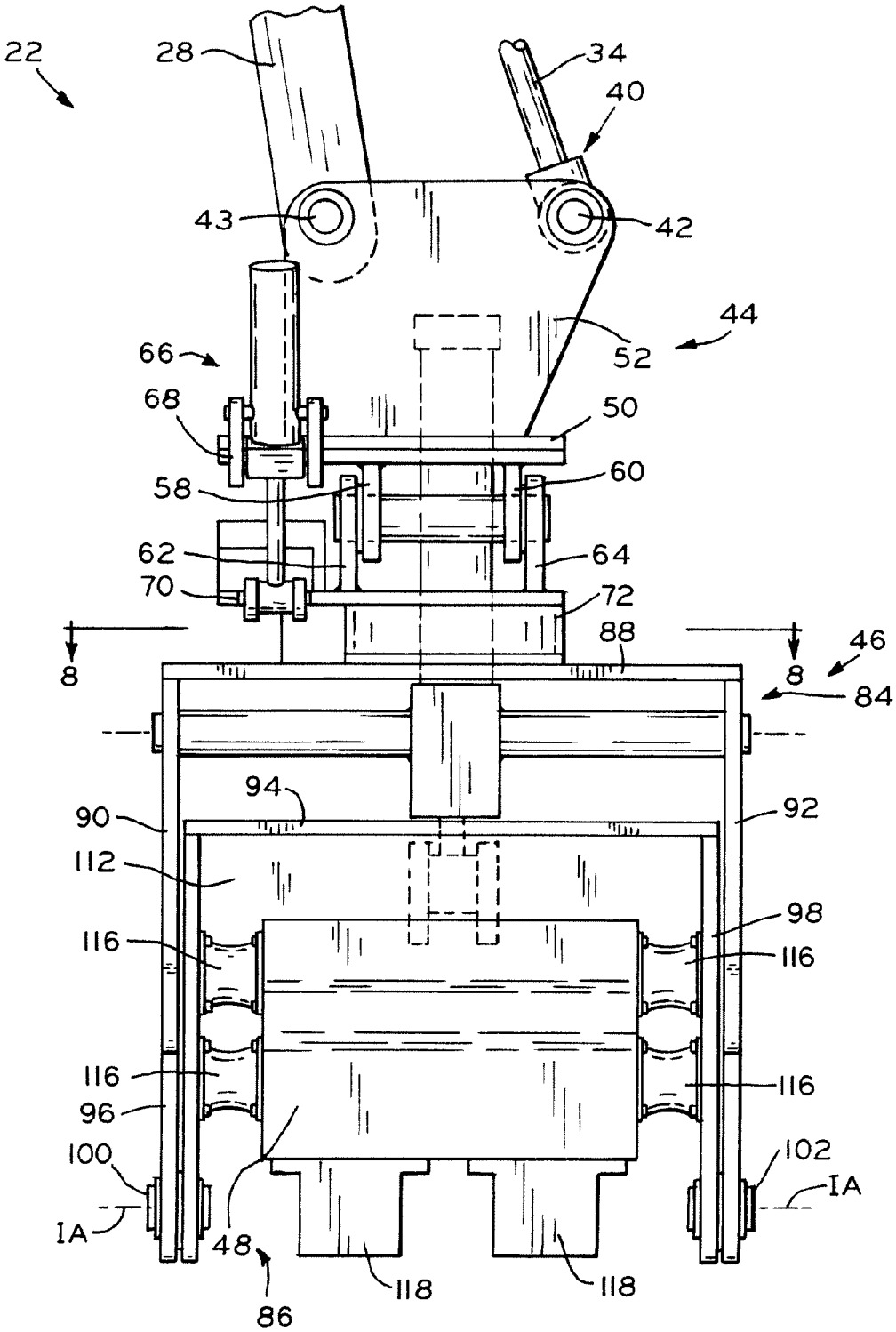
FIG. 5 is a front, elevational view of the vibratory pile driver and articulated boom of FIG. 4.

Referring to FIGS. 3-6, body 46 of pile driver 22 is positioned below head portion 44 and is rotatably secured to head portion 44 by pin 56. As shown in FIG. 5, pin 56 extends through openings in plates 58, 60, which extend downwardly from head portion 44, and plates 62, 64, which extend upwardly from body portion 46. Pin 56 may be secured in position using pins or other known fasteners to limit translation of pin 56 relative to plates 58, 60, 62, 64. As shown in FIG. 4, with pin 56 in this position, pin 56 forms a fixed body pivot element defining first body axis of rotation $BA_1$ about which body portion 46 of pile driver 22 may be rotated relative to head portion 44. First body axis of rotation $BA_1$ extends in a direction substantially orthogonal to pile driver rotational axis PA. Hydraulic cylinder 66 is secured to head portion 44 at pivot 68 and is secured to body 46 by pin 70. By actuating hydraulic cylinder 66, a force is applied to body 46 by cylinder 66 via pin 70. As a result, body 46 is rotated relative to head portion 44 about first body axis of rotation $BA_1$ defined by the fixed body pivot element formed by pin 56. While pin 56 is described and depicted herein as forming the fixed body pivot element that defines first body axis of rotation $BA_1$ about which body 46 is rotatable relative to head 44, any known mechanism for creating an axis of rotation, such as a worm gear mechanism, may be used to form the fixed body pivot element that defines first body axis of rotation $BA_1$. In one exemplary embodiment, body portion 46 is rotatable about first body axis of rotation $BA_1$ through 60°.

Figure 8:
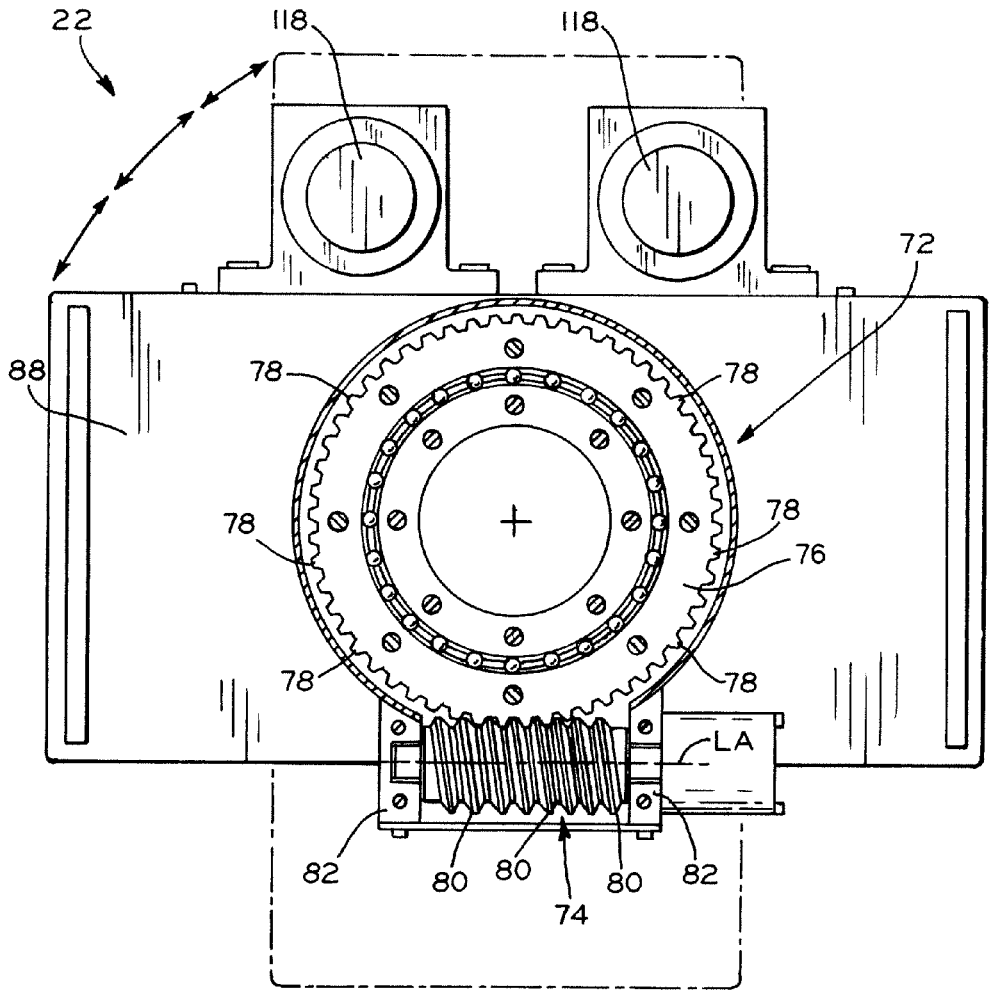
FIG. 8 is a cross-sectional view of the vibratory pile driver of FIG. 4 taken along line 8-8 of FIG. 5.

In addition to rotation about first body axis of rotation $BA_1$, the lower portion of body 46 is rotatable relative the head portion 44 through 360° about second body axis of rotation $BA_2$, shown in FIG. 4. Second body axis of rotation $BA_2$ is substantially orthogonal to both pile driver rotational axis PA and first body axis of rotation $BA_1$. Referring to FIG. 8, rotation of the lower portion of body 46 about second body axis of rotation $BA_2$ is achieved by a rotation mechanism, such as worm gear mechanism 72, which defines another fixed body pivot element. Worm gear mechanism 72 includes worm 74 and worm gear 76. Worm gear 76 includes a plurality of teeth 78 configured to meshingly engage thread 80 extending from worm 74. Worm 74 is translationally fixed by opposing brackets 82, but is free to rotate about longitudinal axis LA. Rotation of worm 74 may be achieved in any known manner, such as by using a hydraulic motor. As worm 74 is driven to rotate about longitudinal axis LA, thread 80 engages teeth 78 and causes corresponding rotation of worm 76. As worm gear 76 rotates, the lower portion of body 46 of pile driver 22, which is rotationally fixed thereto, correspondingly rotates. By rotating worm 74, the lower portion of body 46 may be rotated through 360°. In addition, the direction of rotation of the lower portion of body 56 may be reversed by reversing the direction of rotation of worm 74.

Figure 6:
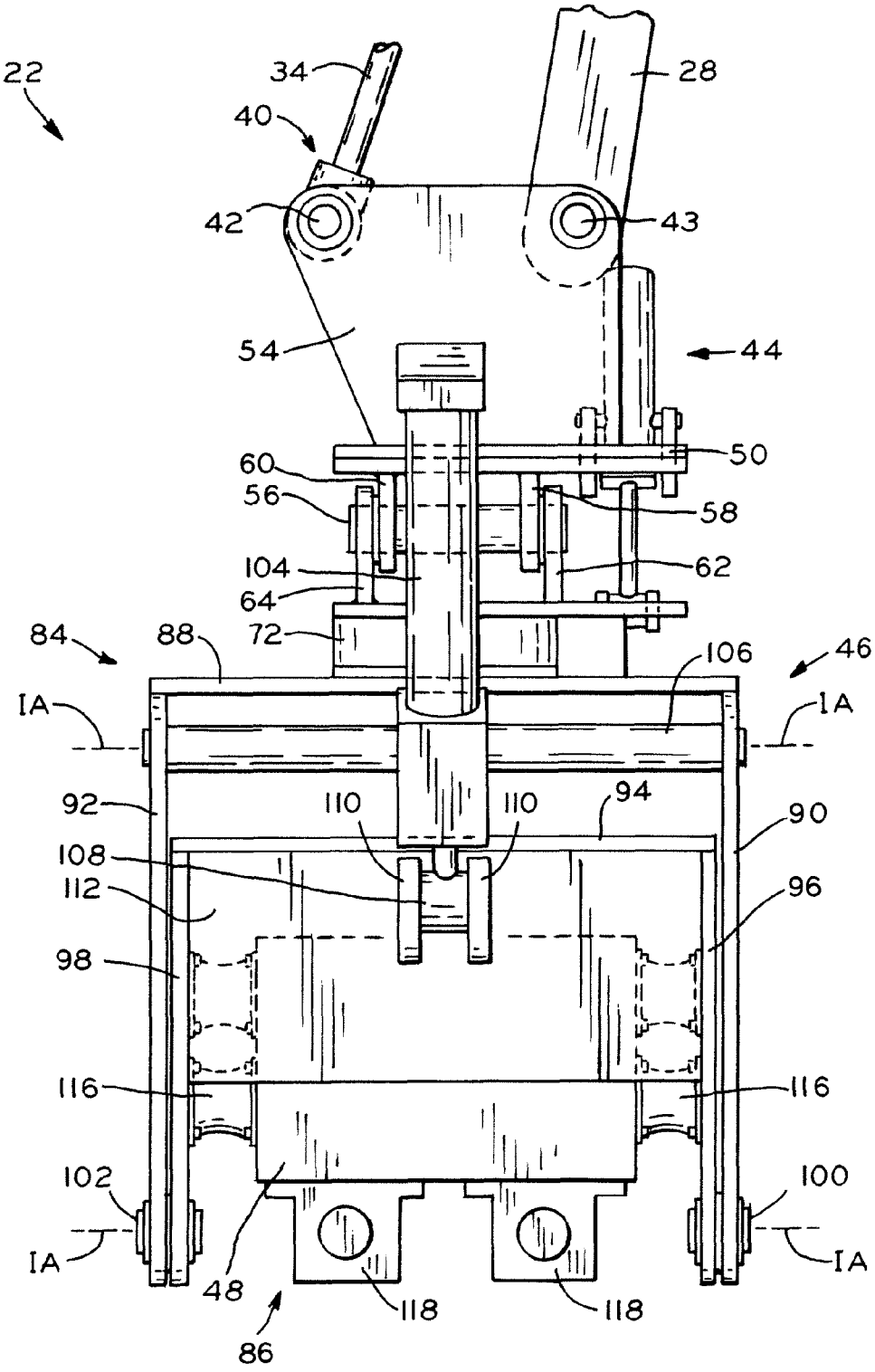
FIG. 6 is rear, elevational view of the vibratory pile driver and articulated boom of FIG. 4.

Referring again to FIGS. 3-7, the lower portion of body 46 of pile driver 22 includes upper support head 84 and lower drive head 86. As shown in FIGS. 5 and 6, upper support head 84 includes top plate 88 and opposing side plates 90, 92, which are spaced apart from one another and secured to opposing edges of top plate 88. Lower drive head 86 is positioned between side plates 90, 92 of upper support head 84 and is secured to side plates 90, 92 of upper support head 84. Specifically, lower drive head 86 includes top plate 94, opposing side plates 96, 98, and rear plate 112 (FIG. 6) that extends between opposing side plates 96, 98 and is secured to side plates 96, 98 and top plate 94. Side plates 96, 98 of lower drive head 86 are translationally secured to side plates 90, 92 of upper support head 84 by pins 100, 102. Pin 100 extends through openings in side plates 90, 96 of upper support head 84 and lower drive head 86, respectively. Similarly, pin 102 extends through openings in side plates 92, 98 of upper support head 84 and lower drive head 86, respectively. A pin or any other known fastener may be used to secure pins 100, 102 in position and prevent translation of pins 100, 102 relative to side plates 90, 92, 96, 98. Pins 100, 102 cooperate to form a fixed insertion pivot element about which lower drive head 86 is rotatable relative to upper support head 84 along insertion axis IA, shown in FIG. 4 and described in detail below, defined by the fixed insertion pivot element.

Figure 7:
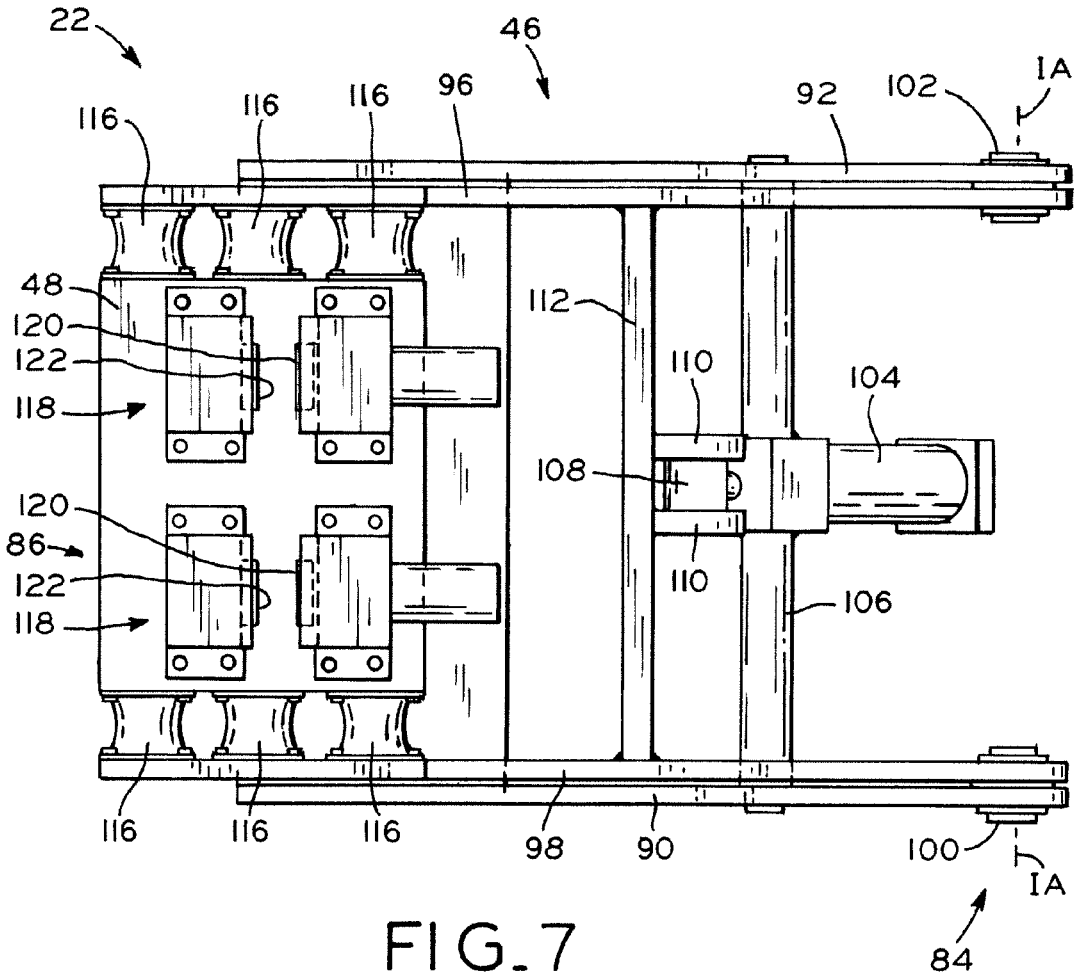
FIG. 7 is a bottom view of the vibratory pile driver of FIG. 4.

Referring to FIGS. 4, 6, and 7, lower drive head 86 of body portion 46 may be rotated about pins 100, 102 by operation of hydraulic cylinder 104. As shown in FIG. 6, hydraulic cylinder 104 is secured to side plates 90, 92 of upper support head 84 by pin 106 which extends through openings in side plates 90, 92 and through a corresponding opening in hydraulic cylinder 104. An opposing end of hydraulic cylinder 104 is secured to lower drive head 86 at pivot 108. Pivot 108 may be formed by positioning an end of hydraulic cylinder 104 between opposing ears 110, shown in FIGS. 6 and 7, that extend upwardly from rear plate 112. Then, a pin is inserted through an opening in one of ears 110, through a corresponding opening in hydraulic cylinder 104, and through an opening in the opposing ear 110 to form pivot 108. As shown in FIG. 2, with hydraulic cylinder 104 rotatably secured to upper support head 84 and lower drive head 86, as hydraulic cylinder 104 is actuated, a force is applied to lower driver head 86 causing lower drive head 86 to rotate relative to upper support head 83 on insertion axis IA that is defined by the fixed insertion pivot element formed by pins 100, 102. Further, insertion axis IA is positioned below pile driver rotational axis PA, first body axis of rotation $BA_1$, and second body axis of rotation $BA_2$, as described in detail above, which allows for insertion axis IA to be rotated about any of pile driver rotational axis PA, first body axis of rotation $BA_1$, and second body axis of rotation $BA_2$, as described in detail below.

Referring again to FIGS. 2-7, vibration generator 48 is secured between side plates 96, 98 of lower drive head 86. Specifically, vibration generator 48 is secured to side plates 96, 98 via dampers 116. Dampers 116 are connected to side plates 96, 98 and vibration generator 48 to limit the transmission of vibration generated by vibration generator 48 through pile driver 22 and, correspondingly, through articulated boom 24 of excavator 20. Vibration generator 48 operates by utilizing a pair of opposed eccentric weights (not shown) configured to rotate in opposing directions. As the eccentric weights are rotated in opposing directions, vibration is transmitted to a connection mechanism, such as clamps 118, positioned on vibration generator 48. Additionally, any vibration that may be generated in the direction of side plates 96, 98 of lower drive head 86 may be substantially reduced by synchronizing the rotation of the eccentric weights. While vibration generator 48 is described herein as generating vibration utilizing a pair of eccentric weights, any known mechanism for generating vibration may be utilized. Additionally, as indicated above and depending on soil conditions, vibration generator 48 may be absent from pile driver 22 and pile driver 22 may utilize hydraulic power generated by excavator 20 or a separate hydraulic pump (not shown) to advance curved sheet pile 10 into subterranean material 18 without the need for vibration generator 48.

As shown in FIGS. 3 and 7, clamps 118 are secured to vibration generator 48 such that vibration generated by vibration generator 48 is transferred to clamps 118, causing clamps 118 to vibrate in the direction of arrow A of FIG. 3 that is substantially parallel to insertion axis IA. Additionally, clamps 118 are positioned on vibration generator 48 such that clamps 118 are positioned below insertion axis IA when clamps 118 are rotated about insertion axis IA in a direction away from articulated boom 24 of excavator 20. As a result, in this position, insertion axis IA is positioned between clamps 118 and each of pile driver rotational axis PA, first body axis of rotation $BA_1$, and second body axis of rotation $BA_2$.

Clamps 118 extend outwardly from vibration generator 48 and beyond opposing side plates 96, 98. Clamps 118 include clamp surfaces 120, 122, which are separated by distance D, as shown in FIG. 3 with clamps 118 in an open position. Clamp surfaces 120, 122 are substantially planar and extend in a plane that is substantially parallel to insertion axis IA. As used herein with respect to clamp surfaces 120, 122, the phrase "substantially planar" is intended to include surfaces that would form substantially planar surfaces, but for the inclusion of undulations, projections, depressions, knurling, or any other surface feature intended to increase friction between clamps surface 120, 122 and a section of curved sheet pile. In one exemplary embodiment, at least one of clamp surfaces 120, 122 is actuatable toward the other of clamp surfaces 120, 122 to secure a section of curved sheet pile 10 therebetween. Additionally, clamps 118 are positioned such that, with clamp surfaces 120, 122 in a closed position, i.e., in contact with one another, clamp surfaces 120, 122 are spaced an insertion distance ID from insertion axis IA of pile driver 22, as shown in FIG. 3.

Figure 9:
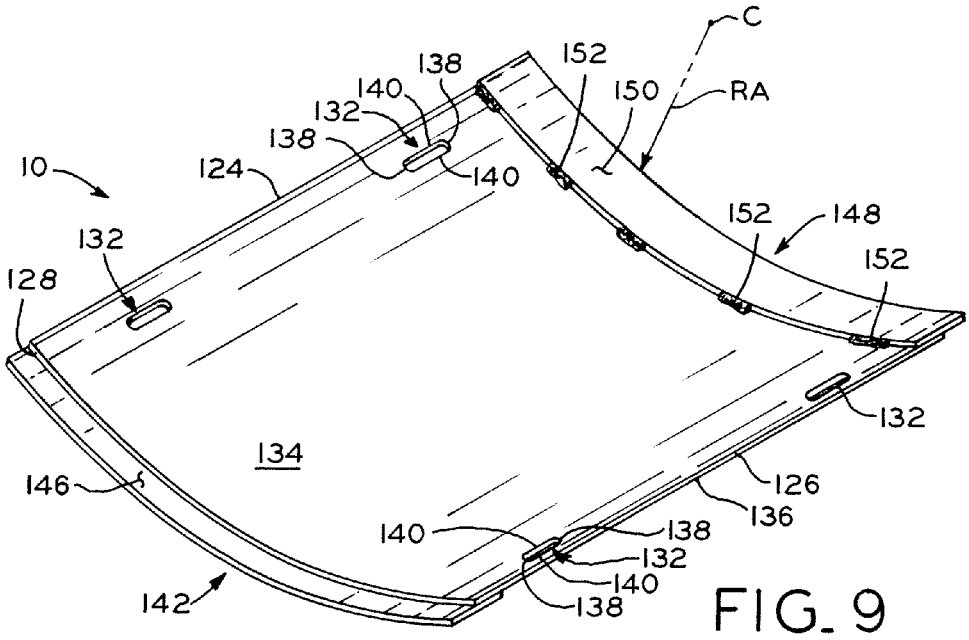
FIG. 9 is a perspective view of a section of curved sheet pile according to an exemplary embodiment.
Figure 10:
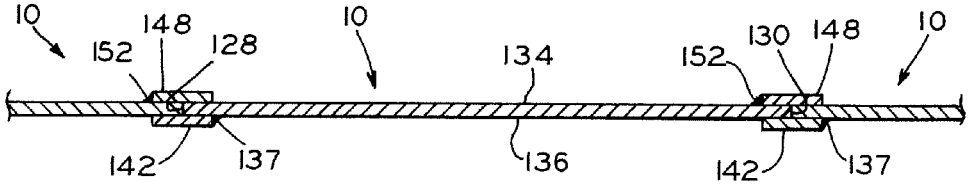
FIG. 10 is a cross-sectional view of a plurality of sections of curved sheet pile of FIG. 9 interlocked together.

Referring to FIGS. 9 and 10, sections of curved sheet pile 10 are shown. Curved sheet pile 10 includes radius of curvature RA that extends between rear gripping edge 124 and front or leading edge 126 of curved sheet pile 10. In exemplary embodiments, radius of curvature RA of curved sheet pile 10 may be as small as 3.0 feet, 4.0 feet, 5.0 feet, 6.0 feet, 8.0 feet, or 10.0 feet and may be as large as 11.0 feet, 12.0 feet, 14.0 feet, 15.0 feet, 16.0 feet, 18 feet, or 20 feet. Side edges 128, 130 of curved sheet pile 10, which has the same radius of curvature RA, extend between gripping edge 124 and leading edge 126 and cooperate with gripping edge 124 and leading edge 126 to define a perimeter of curved sheet pile 10. Openings 132 extend through curved sheet pile 10 between upper surface 134 and lower surface 136 of curved sheet pile 10 to provide openings for securement of curved sheet pile 10 to a beam or other support structure positioned above the excavated opening. In one exemplary embodiment, openings 132 in the form of slots are positioned at the corners of curved sheet pile 10 formed between gripping edge 124, leading edge 126, and side edges 128, 130. Additionally, in another exemplary embodiment, openings 132 are positioned substantially adjacent to gripping edge 124 and leading edge 126. As shown in FIG. 9, openings 132 are formed as slots having arcuate ends 138 that connect opposing straight sidewalls 140.

Referring to FIGS. 9 and 10, curved sheet pile 10 also includes flange 142 extending from lower surface 136 thereof. Flange 142 may be secured to lower surface 136 of curved sheet pile 10 in any known manner, such as by welding. For example, flange 142 may be secured to lower surface 136 of curved sheet pile 10 by welds 137. Additionally, by offsetting support surface 146 of flange 142 relative to upper surface 134 of curved sheet pile 10, support surface 146 may be positioned to extend under lower surface 136 of an adjacent section of curved sheet pile 10 to provide for the alignment and support of the adjacent section of curved sheet pile 10, while maintaining upper surfaces 134 of adjacent section of curved sheet pile 10 substantially evenly aligned with one another between gripping edges 124 and leading edges 126. As a result, the centers C of the radiuses of curvature RA of each of the adjacent sections of curved sheet pile 10 are positioned on a single line. In addition, to further facilitate securement and interlocking of adjacent sections of curved sheet pile 10, curved sheet pile 10 also includes flange 148 extending from upper surface 134 of curved sheet pile 10. Flange 148 extends beyond side edge 130 of curved sheet pile 10 to define support surface 150. Flange 148 may be secured to curved sheet pile 10 in a known manner, such as by welding. For example, flange 148 may be secured to curved sheet pile 10 at welds 152.

Referring to FIG. 10, sections of curved sheet pile 10 are shown positioned adjacent to and interfit with one another. Flanges 142, 148 of curved sheet pile 10 cooperate with upper and lower surfaces 134, 136 of the adjacent sections of curved sheet pile 10, respectively, to interfit adjacent sections of curved sheet pile 10 to one another. Specifically, flange 142 of curved sheet pile 10 extends beneath lower surface 136 of an adjacent section of curved sheet pile 10. Similarly, flange 148 of an adjacent section of curved sheet pile 10 extends across the upper surface 134 of curved sheet pile 10. Additionally, once in the position shown in FIG. 10, flanges 142, 148 may be further secured to adjacent sections of curved sheet pile 10, such as by welding.

Advantageously, by utilizing flanges 142, 148, flanges 142, 148 act as a seal between adjacent sections of curved sheet pile 10 to prevent the passage of subterranean material 18 between adjacent sections of curved sheet pile 10. In addition flanges 142, 148 also act as a guide to facilitate alignment of adjacent sections of curved sheet pile 10 during insertion and also compensate for misalignment of individual sections of curved sheet pile 10. Additionally, flanges 142, 148 allow for the creation of an interconnection and interlocking between adjacent sections of curved sheet pile 10 that facilitates the transfer of loading between adjacent sections of curved sheet pile 10. This also allows for individual sections of curved sheet pile 10 to cooperate with one another to act as a unitary structure for supporting a conduit, such as conduit 12. Further, by acting as a unitary structure, sections of curved sheet pile 10 may be substantially simultaneously lifted without the need to lift each individual section of curved sheet pile 10 independently. Flanges 142, 148 also stiffen each individual section of curved sheet pile 10, which makes each individual section of curved sheet pile 10 more resistant to bending during insertion.

Referring to FIG. 2, in order to insert a section of curved sheet pile 10 into subterranean material 18, the section of curved sheet pile 10 is connected to pile driver 22. Specifically, in order to connect a section of curved sheet pile 10 to pile driver 22, clamps 118 are positioned to grasp gripping edge 124 of curved sheet pile 10. By positioning gripping edge 124 of curved sheet pile 10 such that it extends beyond first and second clamp surfaces 120, 122 in the direction of pile driver 22, one of first and second clamp surfaces 120, 122 may be advanced toward the other of clamp surfaces 120, 122 to capture curved sheet pile 10 therebetween. In one exemplary embodiment, curved sheet pile 10 may be formed to have a radius of curvature RA that is substantially identical to insertion distance ID of pile driver 22.

With curved sheet pile 10 secured by clamps 118, as shown in FIG. 2, arm 28 of excavator 20 is manipulated to position pile driver 22 adjacent to conduit 12. Then, with pile driver 22 positioned adjacent to conduit 12 and subterranean material 18, pile driver 22 may be manipulated to align curved sheet pile 10 with conduit 12. Specifically, pile driver 22 may be manipulated by rotating pile driver 22 about any of pile driver rotational axis PA, first body axis of rotation $BA_1$, and second body axis of rotation $BA_2$, as described in detail above, to align curved sheet pile 10 such that leading edge 126 of curved sheet pile 10 is substantially parallel to and below conduit 12. In one exemplary embodiment, pile driver 22 may be manipulated to position insertion axis IA, which is defined by pins 100, 102, directly vertically above center CC of conduit 12.

Advantageously, the use of pile driver 22 allows curved sheet pile 10 to be properly aligned with and inserted beneath conduit 12, while allowing for the body of excavator 20 to be placed in any position from which excavator 20 may be manipulated to position pile driver 22 adjacent to conduit 12. Stated another way, the use of pile driver 22 of the present invention allows for the alignment of pile driver 22 and curved sheet pile 10 relative to conduit 12 to be performed generally irrespective of the position of excavator 22. For example, because insertion axis IA of pile driver 22 may be moved independent of arm 28 of articulated boom 24 of excavator 20, pile driver 22 may be actuated about any of pile driver rotational axis PA, first body axis of rotation $BA_1$, and second body axis of rotation $BA_2$, as described in detail above, to place insertion axis IA and, correspondingly, curved sheet pile 10, in the proper position for the insertion of curved sheet pile 10 beneath conduit 12. Further, because insertion axis IA of pile driver 22 is positioned between clamps 118 and each of pile driver rotational axis PA, first body axis of rotation $BA_1$, and second body axis of rotation $BA_2$, the position of insertion axis IA and, correspondingly, the position of clamps 118 and curved sheet pile 10 may be manipulated by rotating the fixed insertion pivot element that defines insertion axis IA about any of pile driver rotational axis PA, first body axis of rotation $BA_1$, and second body axis of rotation $BA_2$. Thus, once arm 28 of articulated boom 24 has been manipulated to position pile driver 22 adjacent to conduit 12, any additional manipulation of curved sheet pile 10 that may be necessary to position curved sheet pile 10 in the proper position for insertion beneath conduit 12 is performed by pile driver 22 by rotating insertion axis IA about pile driver rotational axis PA, first body axis of rotation $BA_1$, and second body axis of rotation $BA_2$. This is beneficial, particularly in urban environments, where limited access to conduit 12 may be available and/or where buildings or other structures may limit the ability to position excavator 20 relative to conduit 12.

Once curved sheet pile 10 is positioned within the excavated opening and before leading edge 126 of curved sheet pile 10 is advanced into subterranean material 18, the position of pile driver 22 and/or excavator 20 may be locked, such that movement of pile driver 22 and/or excavator 20 is substantially limited or entirely prevented. In one exemplary embodiment, movement of pile driver 22 is entirely prevented, except for rotation of lower drive head 86 relative to upper support head 84. Then, with the position of pile driver 22 and/or excavator 20 fixed, hydraulic cylinder 104 is extended causing lower drive head 86 and, correspondingly, vibration generator 48 and curved sheet pile 10, to rotate about insertion axis IA defined by pins 100, 102.

Advantageously, by selecting a section of curved sheet pile 10 for insertion beneath conduit 12 that has a radius of curvature RA that is substantially identical to insertion distance ID of pile driver 22 and positioning clamps 118 such that the center of the radius of curvature RA of curved sheet pile 10 lies substantially on insertion axis IA, curved sheet pile 10 may be inserted along an arc having a radius of curvature that is substantially identical to the radius of curvature RA of curved sheet pile 10. Further, by positioning clamps 118 such that insertion distance ID is substantially equal to radius of curvature RA of curved sheet pile 10 and center C of radius of curvature RA of curved sheet pile 10 lies substantially on insertion axis IA, pile driver 22 may be actuated solely about insertion axis IA to allow pile driver 22 to position curved sheet pile 10 beneath conduit 12 and eliminating the need for any additional movement of pile driver 22 and/or articulated boom 24 of excavator 20. Stated another way, with insertion distance ID being substantially identical to radius of curvature RA of curved sheet pile 10, a point that lies substantially on insertion axis IA defines center C of radius of curvature RA of curved sheet pile 10, as shown in FIG. 2. While described herein as having insertion distance ID being substantially identical to the radius of curvature of RA of curved sheet pile 10, insertion distance ID may be a few percent, e.g., 1%, 2%, or 3%, less than or greater than radius of curvature RA of curved sheet pile 10, while still operating in a similar manner as described in detail herein and also providing the benefits identified herein.

Figure 11:
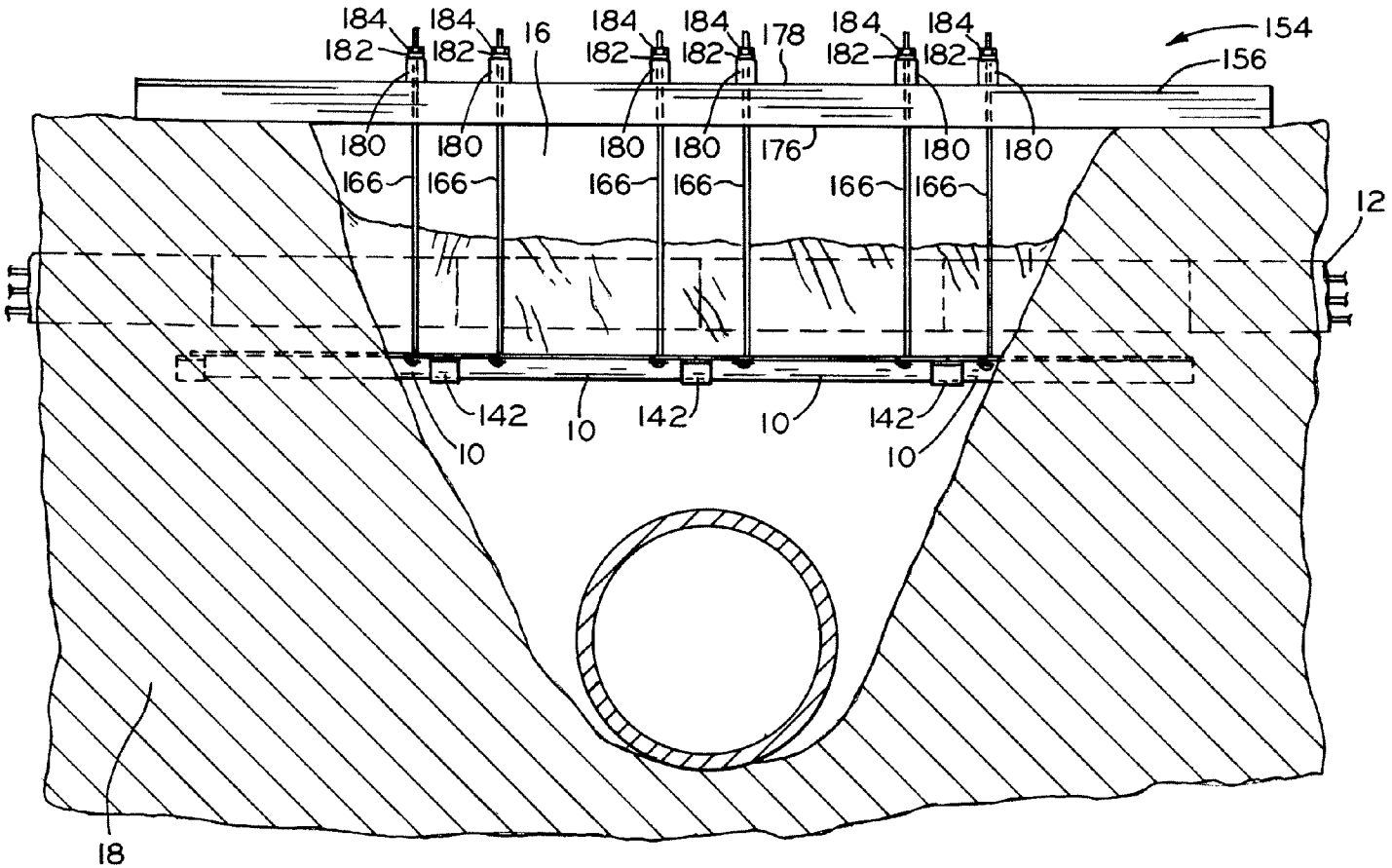
FIG. 11 is a fragmentary, partial cross-sectional view of a plurality of sections of curved sheet pile positioned beneath the conduit and secured in position by a support system.
Figures 12, 13, 14:
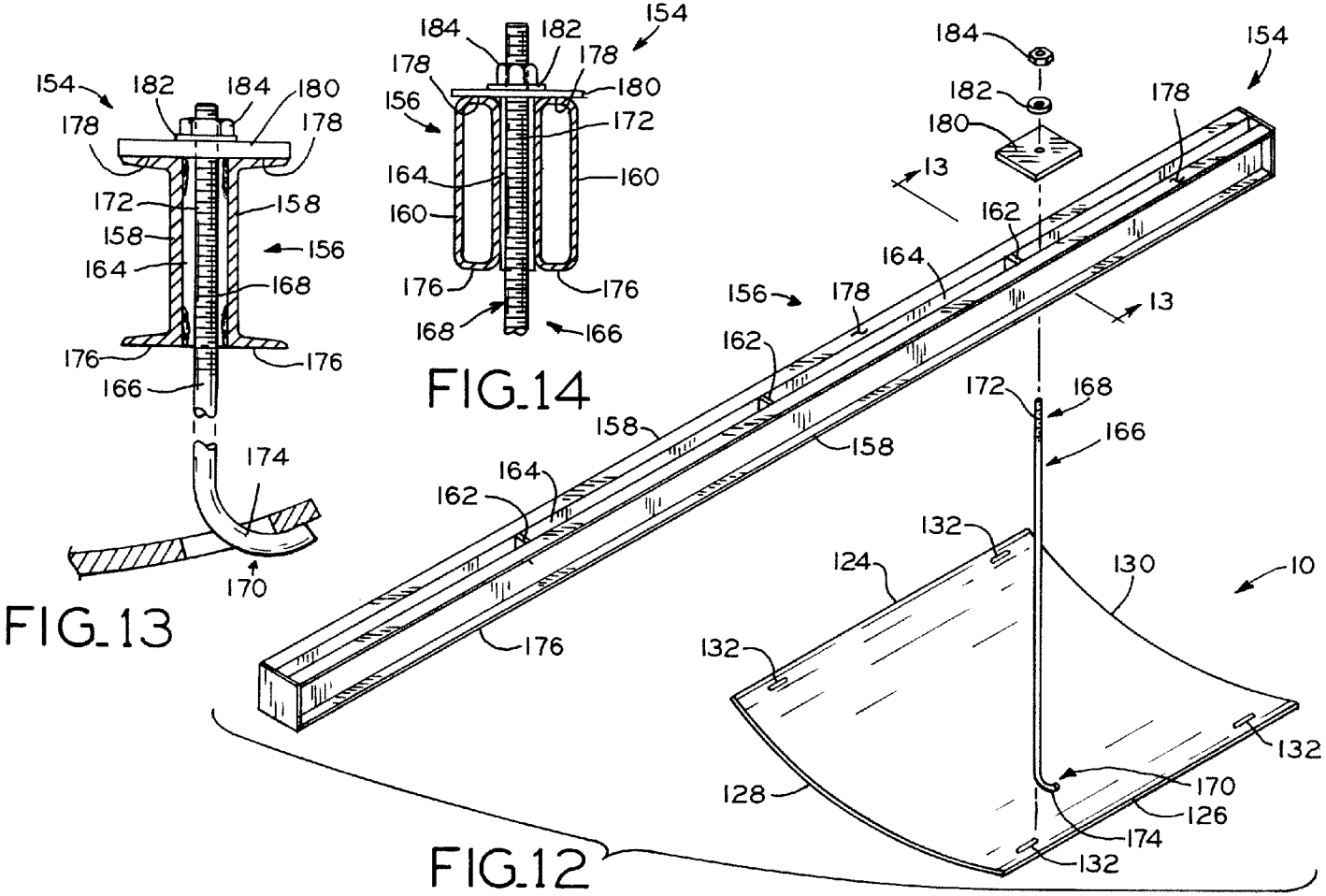
FIG. 12 is an exploded perspective view of the support system of FIG. 11.
FIG. 13 is a fragmentary, cross-sectional view of the support system of FIG. 12 taken along line 13-13 of FIG. 12.
FIG. 14 is a fragmentary, cross-sectional view of the support system according to another exemplary embodiment.

Referring to FIGS. 11-14, support structure 154 for supporting sections of curved sheet pile 10 after sections of curved sheet pile 10 have been inserted within subterranean material 18 is shown. In the preferred embodiment, curved sheet pile 10, as shown in detail in FIGS. 9 and 10, is used to provide for the interconnection and interlocking of adjacent sections of curved sheet pile 10. However, for clarity, only lower flanges 142 are shown in FIG. 11 and no flanges 142, 148 are shown in FIG. 12. Referring to FIGS. 11, beams 156 of support system 154 are positioned to extend across trench 16 formed in subterranean material 18. In this manner, the opposing ends of beams 156 that contact a surface on opposing sides of trench 16 provide a basis of support for sections of curved sheet pile 10.

Referring to FIGS. 12-14, in one exemplary embodiment, beams 156 are formed as two adjacent sections of stringer, i.e., a horizontal, elongate member used as a support or a connector. In one exemplary embodiment, beams 156 are formed from any two adjacent sections of stringer that may be combined to support the load of curved sheet pile 10 and subterranean material 18, such as two sections of channeling 158, i.e., a structural member having the form of three sides of a rectangle or square, as shown in FIG. 14. Alternatively, the stringer used to form beams 156 may be hollow bar stock 160, as shown in FIG. 15. Irrespective of the stringer used to form beams 156, e.g., channeling 158 and/or bar stock 160, the adjacent sections of stringer are spaced from one another by a distance defined by spacers 162 that are positioned between adjacent sections of stringer and secured thereto. In one exemplary embodiment, spacers 162 are formed of steel plates and are welded to the adjacent sections of stringer to form beams 166. Spacers 162 cooperate with adjacent sections of stringer to define opening or gap 164 therebetween. Gap 164 is sized to receive a portion of elongate suspension members, such as rods 166, therethrough.

Rods 166, which also form a component of support system 154, include beam connection ends 168 and opposing pile connection ends 170. In one exemplary embodiment, beam connection ends 168 are formed as threaded ends 172 and pile connection ends 170 are formed as J-hooks 174. In order to secure rods 166 to sections of curved sheet pile 10, rods 166 are inserted through openings 132 in curved sheet pile 10 by longitudinally aligning J-hooks 174 with planar sidewalls 140 of openings 132. J-hooks 174 are then advanced through openings 132 and rotated 90° to capture a portion of curved sheet pile 10 on J-hooks 174 to prevent J-hooks 174 from advancing back out of openings 132.

In order to secure rods 166 to beams 156, threaded ends 172 of rods 166 are advanced through gap 164 in beams 156. Specifically, threaded end 172 of rods 166 are advanced through beams 156 from lower, ground contacting surfaces 176 until at least a portion of threaded ends 172 extend from beyond upper surfaces 178 of beams 156. Once in this position, threaded ends 172 are passed through openings in support plates 180, which also form a component of support system 154. Support plates 180 are sized to extend across gap 164 and to rest atop upper surface 178 of beams 156. Additionally, in FIG. 12, the size of support plates 180 relative to the other components of support system 154 is exaggerated for clarity. Washers 182 are then received on threaded ends 172 and threaded nuts 184 are threadingly engaged with threaded ends 172. Threaded nuts 184 are then advanced along threaded ends 172 of rods 166 in a direction toward upper surface 178 of beams 156 to capture support plates 180 between upper surface 178 of beams 156 and washers 182 and to secure curved sheet pile 10 to beams 156 via rods 166.

Additionally, even after curved sheet pile 10 is sufficiently supported by beams 156 and rods 166, nuts 184, if desired, may continue to be advanced in the direction of beams 156. As nuts 184 are advanced, rods 166 are correspondingly advanced in the direction of beams 156. This causes curved sheet pile 10, which is now secured to rods 166, to be lifted in the direction of beams 156 to provide additional support to conduit 12. As indicated above, by utilizing curved sheet pile 10, as curved sheet pile 10 is lifted, flanges 142, 148 engage corresponding portions of adjacent sections of curved sheet pile 10, to allow for cooperative lifting of all of the sections of curved sheet pile 10. The process of securing rods 166 between curved sheet pile 10 and beams 156 may be repeated as necessary. Specifically, in one exemplary embodiment, curved sheet piles 10 are secured at each of openings 132 by rods 166 to beams 156.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A system for the insertion of curved sheet pile, the system comprising:

a pile driver comprising:

a head portion configured to connect to a unit of positioning machinery, said head portion defining a first fixed pivot element, said first fixed pivot element defining a pile driver axis of rotation about which said pile driver is rotatable; and a body portion having an upper support head and a lower drive head, said upper support head connected to said head portion, said lower drive head connected to said upper support head to define a second fixed pivot element, said second fixed pivot element defining an insertion axis, said lower drive head including a connection mechanism, said insertion axis being spaced from said connection mechanism by an insertion distance; and a section of curved sheet pile having a pile radius of curvature, said pile radius of curvature being substantially equal to said insertion distance, wherein, with said section of curved sheet pile secured to said connection mechanism, a point defining a center of said pile radius of curvature lies substantially on said insertion axis.

2. The system of claim 1, wherein said connection mechanism of said pile driver comprises a clamp having a pair of opposing clamp surfaces, said insertion axis being spaced from said opposing clamp surfaces by said insertion distance, wherein said insertion distance is measured when said opposing clamp surfaces are in a closed position.

3. The system of claim 1, wherein said pile driver further comprises a vibration generator secured to said lower drive head.

4. The system of claim 3, wherein said connection mechanism of said pile driver comprises a clamp having a pair of opposing clamp surfaces, said clamp connected to said vibration generator.

5. A system for the insertion of curved sheet pile, the system comprising:

a pile driver, comprising:

a head portion configured to connect to an arm of a unit of positioning machinery, wherein the arm has a longitudinal axis; and a body portion having an upper support head and a lower drive head, said upper support head of said body connected to said head portion of said pile driver, said lower drive head connected to said upper support head, said lower drive head having a fixed pivot element defining an insertion axis, said fixed pivot element being rotatable relative to the longitudinal axis of the arm of the unit of positioning machinery to alter the position of said insertion axis, said lower drive head having a connection mechanism, said connection mechanism spaced from said insertion axis by an insertion distance; and a section of curved sheet pile having a pile radius of curvature, said pile radius of curvature being substantially equal to said insertion distance, wherein, with said section of curved sheet pile connected to said lower drive head by said connection mechanism, a point defining a center of said pile radius of curvature lies substantially on said insertion axis and said lower drive head is rotatable about said insertion axis to insert said section of curved sheet pile into subterranean material.

6. The system of claim 5, wherein said connection mechanism of said pile driver comprises a clamp having a pair of opposing clamp surfaces, said insertion axis being spaced from said opposing clamp surfaces by said insertion distance, wherein said insertion distance is measured when said opposing clamp surfaces are in a closed position.

7. The system of claim 5, wherein said pile driver further comprises a vibration generator secured to said lower drive head.

8. The system of claim 7, wherein said connection mechanism of said pile driver comprises a clamp having a pair of opposing clamp surfaces, said clamp connected to said vibration generator.

9. A system for the insertion of curved sheet pile, the system comprising:

a pile driver, comprising:

a head portion configured to connect to an arm of a unit of positioning machinery, wherein the arm has a longitudinal axis; and a body portion connected to said head portion of said pile driver, said body portion having a rotation mechanism operable to drive rotation of at least a portion of said body portion relative to said head portion about a body axis of rotation, said body having a fixed pivot element defining an insertion axis, said fixed pivot element being rotatable about said body axis of rotation and relative to the longitudinal axis of the arm of the unit of positioning machinery to alter the position of said insertion axis, said body having a connection mechanism, said connection mechanism spaced from said insertion axis by an insertion distance, said insertion axis being positioned between said rotation mechanism and said connection mechanism when said connection mechanism is rotated about said insertion axis; and a section of curved sheet pile having a pile radius of curvature, said pile radius of curvature being substantially equal to said insertion distance, wherein, with said section of curved sheet pile connected to said body portion by said connection mechanism, a point defining a center of said pile radius of curvature lies substantially on said insertion axis and said connection mechanism is rotatable about said insertion axis to insert said section of curved sheet pile into subterranean material.

10. The system of claim 9, wherein said connection mechanism of said pile driver comprises a clamp having a pair of opposing clamp surfaces, said insertion axis being spaced from said opposing clamp surfaces by said insertion distance, wherein said insertion distance is measured when said opposing clamp surfaces are in a closed position.

11. The system of claim 9, wherein said pile driver further comprises a vibration generator secured to said body portion.

12. The system of claim 11, wherein said connection mechanism of said pile driver comprises a clamp having a pair of opposing clamp surfaces, said clamp connected to said vibration generator.

* * * * *